US005967903A

United States Patent [19]

Cheng

[11] Patent Number: 5,967,903

[45] **Date of Patent: *Oct. 19, 1999**

[54] GOLF CLUB HEAD WITH SANDWICH STRUCTURE AND METHOD OF MAKING THE SAME

[75] Inventor: Michael H. L. Cheng, Simi Valley, Calif.

[73] Assignee: Harrison Sports, Inc., Pacoima, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/954,690

[22] Filed: Oct. 20, 1997

[51] Int. Cl.[6] ..... A63B 53/04

[52] U.S. Cl. ..... 473/342; 473/349

[58] Field of Search ..... 473/342, 324, 473/330, 331, 332, 349; 273/186.2, 192, 184 R, 183.1

[56] References Cited

U.S. PATENT DOCUMENTS 3,989,248 11/1976 Campau .
4,398,965 8/1983 Campau .
4,449,707 5/1984 Hayashi et al. .
4,883,275 11/1989 Boone .
4,884,812 12/1989 Nagasaki et al. ..... 473/342
5,184,823 2/1993 Desboilles et al. .
5,316,298 5/1994 Hutin et al. .
5,398,929 3/1995 Kitaichi ..... 473/342
5,403,007 4/1995 Chen ..... 473/342 X
5,405,136 4/1995 Hardman .
5,409,229 4/1995 Schmidt et al. .
5,447,311 9/1995 Viollaz et al. .
5,492,327 2/1996 Biafore, Jr. .
5,522,593 6/1996 Kobayashi et al. .
5,540,436 7/1996 Boone .
5,584,770 12/1996 Jensen .
5,586,947 12/1996 Hutin .
5,669,829 9/1997 Lin ..... 473/342 X
5,779,560 7/1998 Buck et al. ..... 473/342
5,827,131 10/1998 Mahaffey et al. ..... 473/342

*Primary Examiner*—Kien T. Nguyen
*Attorney, Agent, or Firm*—Henricks, Slavin & Holmes LLP

[57] ABSTRACT

A golf club head including a main body portion having a groove formed therein and a striking assembly associated with the groove. The striking assembly includes a relatively hard front portion and a relatively soft rear portion. The striking assembly is mounted on the main body portion such that the front portion defines the ball striking surface.

16 Claims, 6 Drawing Sheets

PRIOR AT

GOLF CLUB HEAD WITH SANDWICH STRUCTURE AND METHOD OF MAKING THE SAME

BACKGROUND OF THE INVENTION

1. Field of Invention

The present invention relates generally to golf clubs and, more particularly, to golf club heads and methods of making the same.

2. Description of the Related Art

Golf clubs typically include three basic elements—a shaft, a club head at one end of the shaft and a grip at the other end of the shaft. Because golf is a demanding game, golf club manufacturers are continuously trying to improve the performance of each club element. Accuracy is an important aspect of club head performance and perimeter weighting is a popular way to increase accuracy. Perimeter weighting is a method of enlarging the sweet spot of a club head which, in turn, increases the likelihood of accurate shots. As illustrated in FIG. 1, a conventional perimeter weighted club head 10 includes a rear cavity 12 behind the striking face. The volume of metal eliminated from the club head to form the cavity 12 is redistributed towards the perimeter 14 of the club head. As a result, the overall weight of the club head remains substantially unchanged.

Another important aspect of golf club performance is associated with the transmission of impact generated vibrations. When a golfer strikes a golf ball with the club head, vibrations from the club head are transmitted through the shaft to the golfer's hands. When a golfer fails to strike the golf ball with the sweet spot of the club head, the impact generated vibrations can be quite unpleasant. In fact, the vibrations can be so severe that they cause pain and injury. This is an especially serious problem for golfers of relatively low skill levels who frequently fail to strike the ball with the club head sweet spot.

A number of club head-based vibration damping methods have been introduced in order to protect golfers from the unpleasant and injurious vibrations that result from failure to strike the ball properly. For example, one method of reducing the vibrations transmitted by a club head, thereby giving the club a softer feel, is to simply make the ball striking surface from a relatively soft material such as polymers, epoxy or graphite. The present inventor has determined, however, that the use of relatively soft material on the ball striking surface reduces the bite of the club head, thereby reducing the spin on the ball and the golfer's control of his or her shots. The relatively soft material also tends to become scratched easily. Another proposed solution is presented in U.S. Pat. No. 5,492,327, which discloses a club head having damping material located in a recess which extends around a portion of the outer perimeter of the club head. However, the inventor herein has determined that the vibration damping is less than optimal because the perimeter weighting material and the striking face of the club head are an integrally formed unit.

SUMMARY OF THE INVENTION

Accordingly, the general object of the present invention is to provide a golf club head which eliminates, for practical purposes, the aforementioned problems. In particular, one object of the present invention is to provide a golf club head which reduces impact generated vibrations. Still another object is to reduce impact generated vibrations without substantially reducing the bite of the club head.

In order to accomplish some of these and other objectives, a golf club head in accordance with a preferred embodiment of the present invention includes a main body portion having a groove formed therein and a striking assembly associated with the groove. The striking assembly includes a relatively hard front portion and a relatively soft rear portion. The striking assembly is mounted on the main body portion such that the front portion defines the ball striking surface.

This combination provides a number of advantages over conventional club heads. For example, the relatively soft rear portion damps impact generated vibrations, while the relatively hard front portion provides strong bite. As a result, a golfer will be able to enjoy the benefits of club head based vibration damping without sacrificing strong bite. The present club head is also less likely to be scratched than a conventional club head.

Another advantage of the present invention is that the striking assembly, as a whole, typically has a lower density than the main body portion. As such, additional material may be added to the rearward area of the perimeter of the main body portion, as compared to a conventional perimeter weighted club head, without increasing the weight of the club head. The additional material causes the present club head to have a center of gravity that is rearward of the center of gravity of a conventional club head having the same shape. As a result, the present club head has a higher moment of inertia than a conventional club head and a greater resistance to twisting when a ball is struck with the heel or toe of the club head.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

Figure 1:
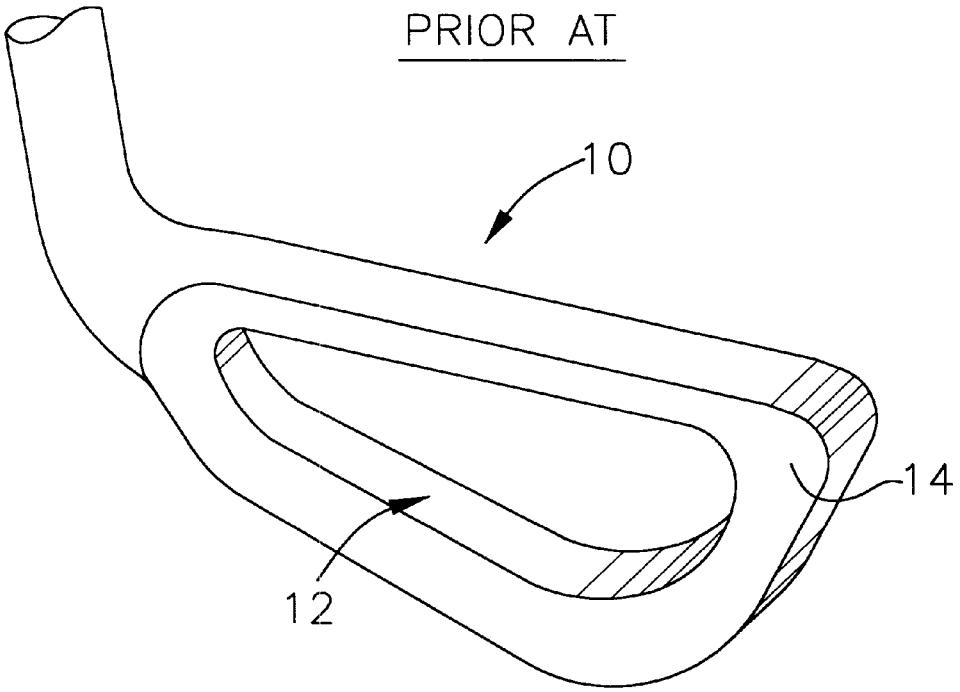
FIG. 1 is a rear perspective view of a conventional perimeter weighted golf club head.

The following is a detailed description of the best presently known mode of carrying out the invention. This description is not to be taken in a limiting sense, but is made merely for the purpose of illustrating the general principles of the invention. The scope of the invention is defined by the appended claims.

As illustrated for example in FIGS. 24, a golf club head 16 in accordance with one embodiment of the present invention includes a main body portion 18 and a hosel portion 20 which is preferably integral with the main body portion. A groove (or recess) 22 is formed in the main body portion 18. The exemplary main body portion 18 also includes an aperture 24 which connects the groove 22 to the rear cavity 26. The golf club head 16 also includes a striking assembly 28 having a relatively hard front portion and a relatively soft rear portion. In the exemplary embodiment, the striking assembly 28 consists of a front member 30 and a rear member 32. A series of score lines 34 are provided on the front surface of the front member 30, which forms the striking surface of the present club head. The score lines are discussed in greater detail below with reference to FIGS. 7 and 8. The striking assembly 28 may be secured to the main body portion 18 by welding, brazing, screws, adhesives, metal interlocking methods, or other suitable techniques.

The striking assembly front member 30 is preferably formed from relatively hard materials such as maraging steel, titanium, and other hard metal matrices. The hardness is preferably between about 25 $R_c$ and about 60 $R_c$ and the thickness is preferably between about 1 mm and about 3 mm. Conversely, the striking assembly rear member 32 is formed from relatively soft materials such as aluminum, bronze, and other soft metal matrices, with hardness values between about 60 BHN and about 95 BHN. The thickness is preferably between about 1.5 mm and about 4 mm. It should be noted that such hardness values are merely exemplary. The primary requirement is that the front member 30 be harder than the rear member 32. It is also preferable, but not necessary, that the rear member be softer than the main body portion. The main body portion 18 is preferably formed from materials such as 431 and 174 stainless steel, cobalt and titanium.

One advantageous result of the present striking assembly configuration, where the striking assembly front member 30 is formed from a relatively hard material and the striking assembly rear member 32 is formed from a relatively soft material, is that the rear member damps impact generated vibrations, while the front member provides strong bite. The present club head therefore provides vibration damping without sacrificing strong bite.

In accordance with another aspect of the invention, the materials for the main body portion 18 and striking assembly 28 may be selected such that the density of the striking assembly is less than that of the main body portion. Thus, as compared to a conventional club head of the same shape and weight, the rearward area of the perimeter of the present main body portion can be larger. This moves the center of gravity of the present club head rearward, as compared to the conventional club head, thereby providing the present club head with a higher moment of inertia and a greater resistance to twisting when a ball is struck with the heel or toe of the club head.

Figure 5:
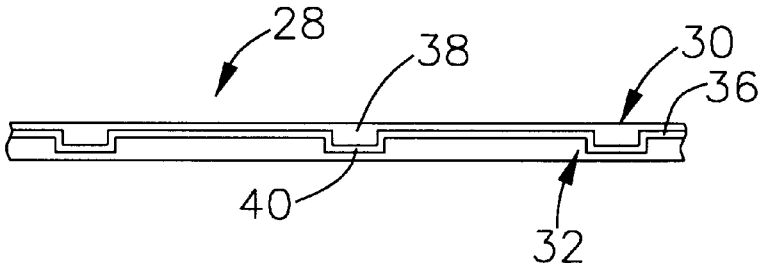
FIG. 5 is a partial top view of an exemplary striking assembly in accordance with the present invention.
Figure 6:
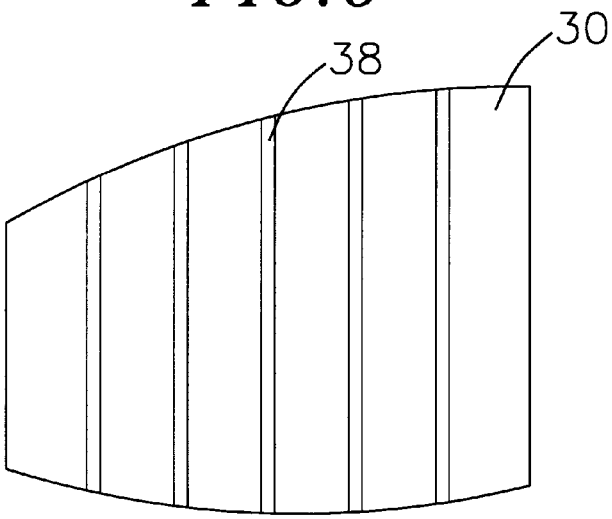
FIG. 6 is a rear view of the striking assembly front member shown in FIG. 5.

As shown by way of example in FIGS. 5 and 6, the front member 30 may be secured to the rear member 32 with a layer of adhesive 36. The adhesive may, if desired, be an adhesive that has vibration damping capability. One example of such an adhesive is epoxy. In the exemplary striking assembly 28 shown in FIGS. 5 and 6, the rear surface of the front member 30 includes a plurality of ridges 38, while the rear member 32 includes a corresponding plurality of indentations 40. This configuration may, of course, be reversed. The ridges and indentations increase the front and rear member surface area in contact with the adhesive, thereby strengthening the bond between the front and rear members. The ridges and indentations also help align the front and rear members relative to one another during fabrication. It should also be noted that the front member 30 may be secured to the rear member 32 through the use of metal interlocking techniques, welding or brazing. Such fabrication techniques may be employed instead of, or in addition to, the adhesive layer 36.

Figure 7:
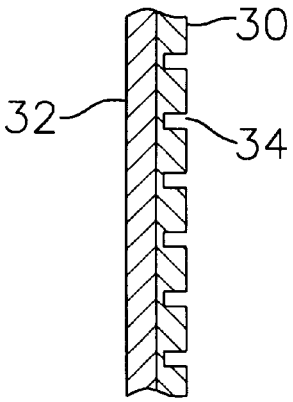
FIG. 7 is an enlarged section view of a striking assembly in accordance with one embodiment of the present invention.
Figure 8:
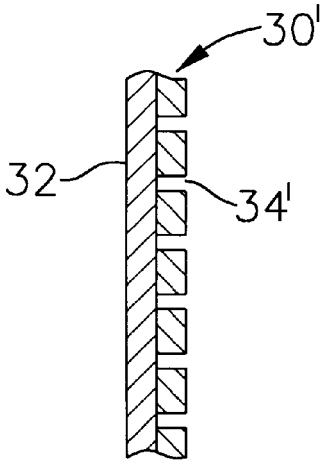
FIG. 8 is an enlarged section view of a striking assembly in accordance with another embodiment of the present invention.

Turning to FIG. 7, the score lines 34 only extend partially into the front member 30. Alternatively, and as illustrated for example in FIG. 8, the score lines 34' can extend all the way through the front member 30'. The score lines 34 or 34' may be cut into the front member either prior to connection to the rear member, or after the front and rear members have been assembled into the striking assembly. In accordance with some embodiments of the present invention, the front member 30 and rear member 32 will be formed from differently colored metals. Thus, one advantage of the embodiment shown in FIG. 8 is that the golfer will be able to observe that the striking assembly 28 is formed from two different metals, which is both informative and aesthetically pleasing.

Figure 2:
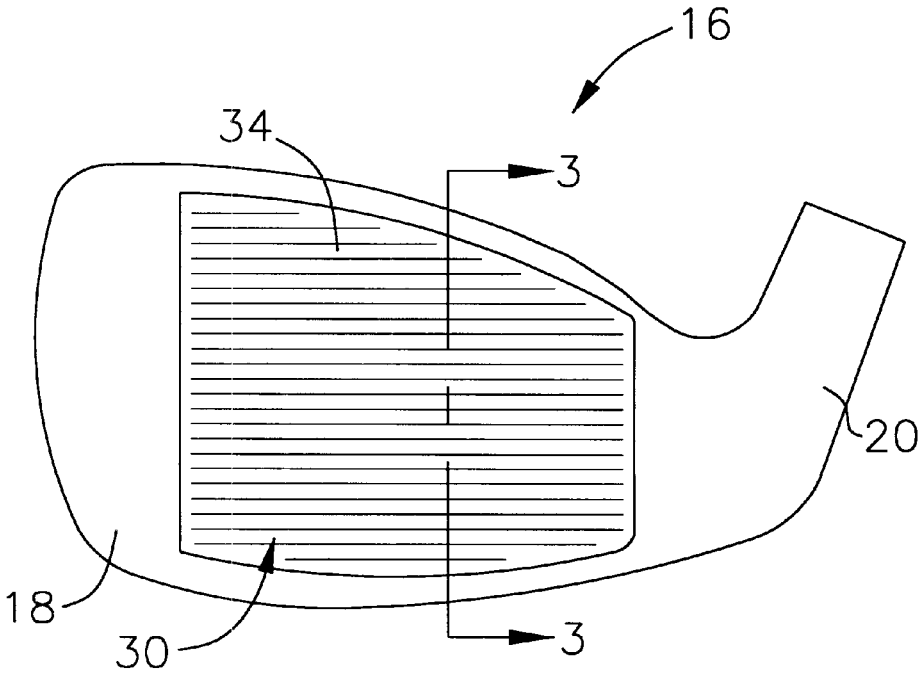
FIG. 2 is front view of a golf club head in accordance with one embodiment of the present invention.
Figure 4:
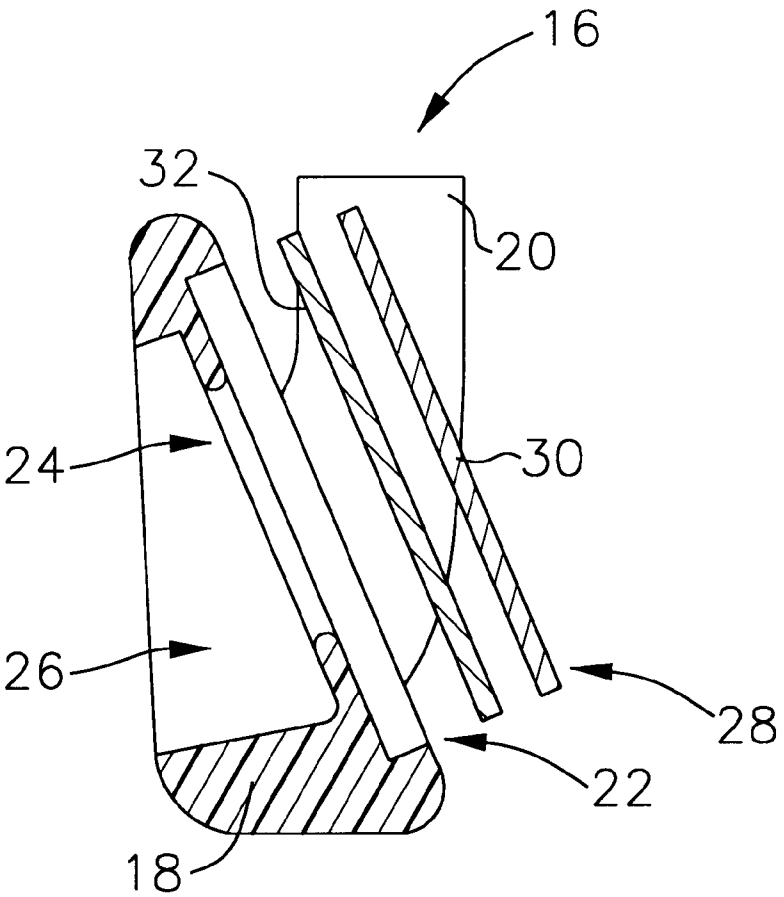
FIG. 4 is an exploded view of the section shown in FIG. 3.
Figure 3:
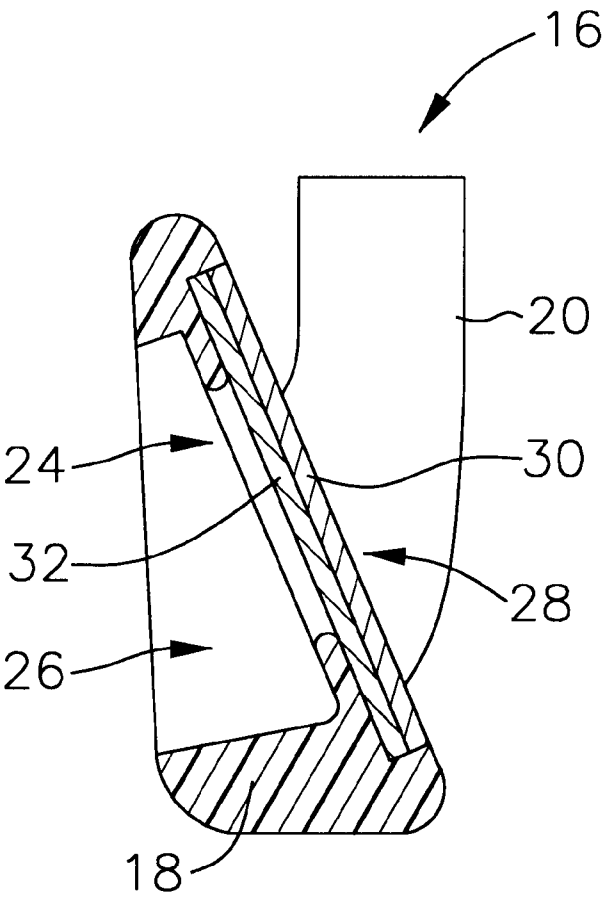
FIG. 3 is a section view taken along line 3—3 in FIG. 2.
Figure 9:
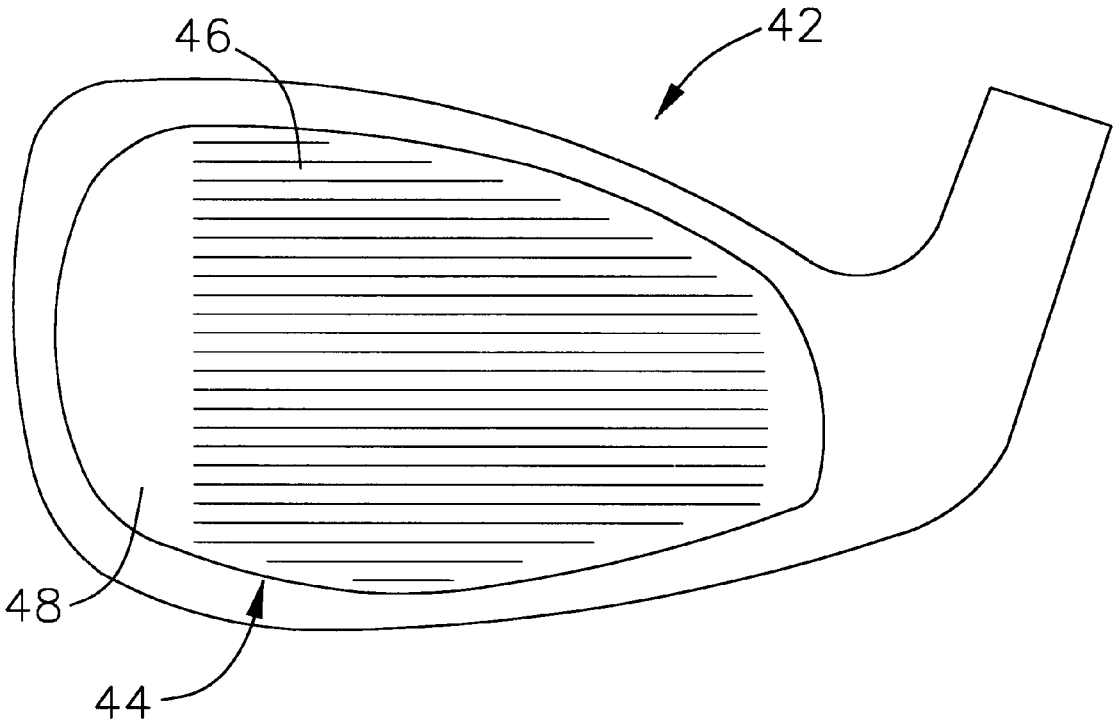
FIG. 9 is front view of a golf club head in accordance with another embodiment of the present invention.
Figure 12:
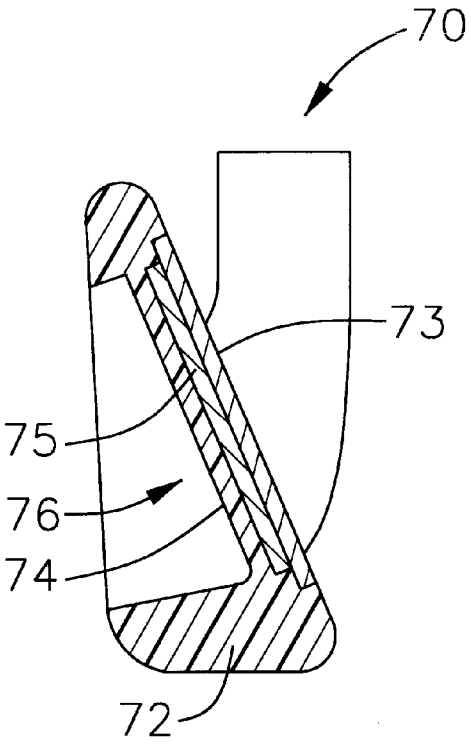
FIG. 12 is a section view of a golf club head in accordance with another embodiment of the present invention.
Figure 11:
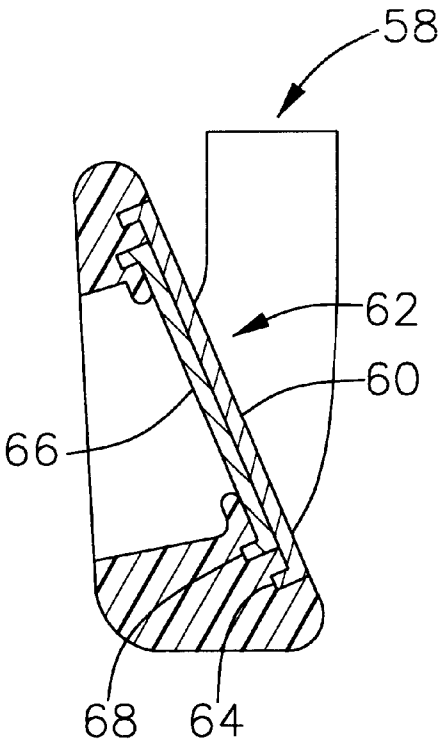
FIG. 11 is a section view of a golf club head in accordance with yet another embodiment of the present invention.
Figure 10:
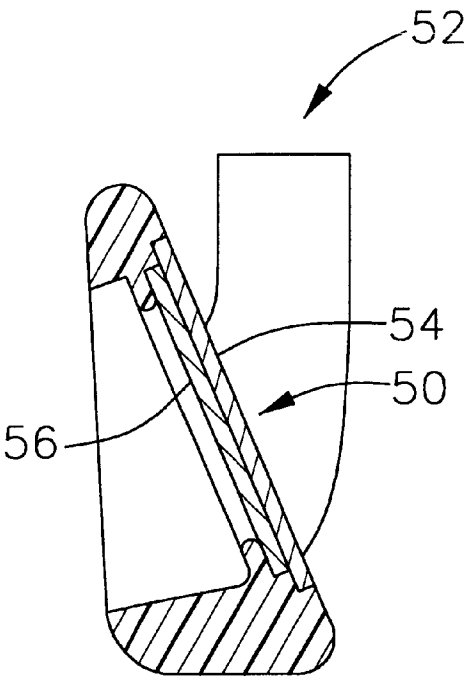
FIG. 10 is a section view of a golf club head in accordance with still another embodiment of the present invention.

The respective configurations of the main body portion 18 and striking assembly 28 are not limited to the configurations shown in FIGS. 2–4. As illustrated for example in FIG. 9, the club head 42 includes a striking assembly 44 that extends laterally to a greater extent than does the exemplary striking assembly 28 (note FIG. 2), although the score lines 46 do not extend completely across the front member 48. As a result, the face of the club head shown in FIG. 9 has a larger area with vibration damping capability than the club head shown in FIG. 2. Additionally, in those embodiments where the overall density of the striking assembly is less than that of the main body portion, even more material may be added to the rearward perimeter area of the main body portion, thereby moving the center of gravity farther back. The striking assembly 50 in the exemplary club head 52 shown in FIG. 10 includes a front member 54 that extends vertically above and below the rear member 56. Such a configuration provides increased bonding surface area between the striking assembly and the main body portion. Turning to the exemplary club head 58 illustrated in FIG. 11, the front member 60 in the striking assembly 62 includes a rearwardly extending pair of protrusions 64 and the rear member 66 includes a pair of rearwardly extending protrusions 68. The protrusions also increase the bonding surface area between the striking assembly and the main body portion. In the exemplary club head 70 shown in FIG. 12, the main body portion 72 includes a wall portion 74 which extends completely across the cavity 76. Here too, the striking assembly includes a relatively hard front member 73 and a relatively soft rear member 75. The wall portion increases the bonding surface area between the striking assembly and the main body portion and also provides structural support when the relatively soft rear member is relatively thick.

Figure 13:
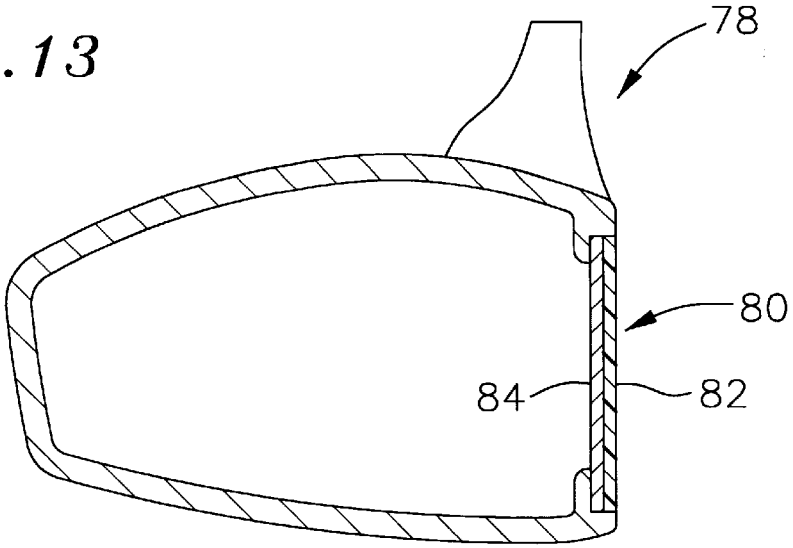
FIG. 13 is a section view of a wood-type golf club head in accordance with still another embodiment of the present invention.
Figure 14:
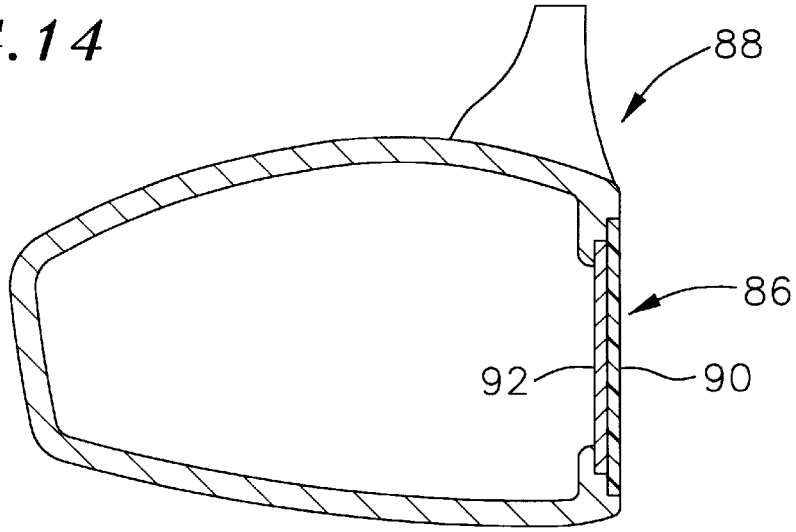
FIG. 14 is a section of a wood-type golf club head in accordance with another embodiment of the present invention.
Figure 15:
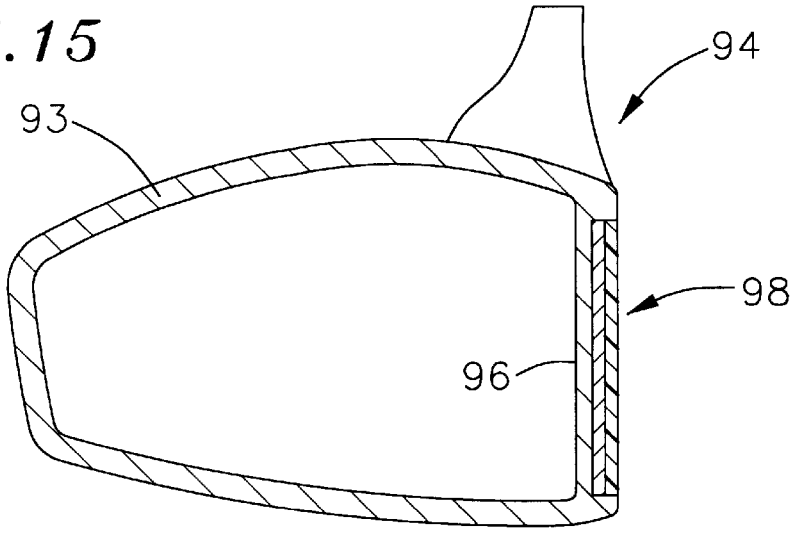
FIG. 15 is a section of a wood-type golf club head in accordance with yet another embodiment of the present invention.

Although the present invention is particularly applicable to perimeter weighted iron-type club heads, such as those illustrated in FIGS. 2–12, the inventive concept is applicable to all types of golf club heads. For example, the present inventive concept is also applicable to woods. The exemplary wood-type club head 78 shown in FIG. 13 includes a striking assembly 80 which consists of a front member 82 and a rear member 84 formed in the manner described above. The striking assembly 80 is also supported by, and mounted in, the main body portion 86 in the manner described above. All of the striking assembly and main body portion variations described above with respect to iron-type club heads are applicable to wood-type club heads. For example, the striking assembly 86 of the club head 88 shown in FIG. 14 includes a front plate 90 that extends vertically to a greater extent than does the rear plate 92. Turning to FIG. 15, the main body portion 93 of the exemplary club head 94 includes a wall portion 96 that separates the striking assembly 98 from the interior of the club head. The wall portion increases the bonding surface area between the striking assembly and the main body portion and also provides structural support when the relatively soft rear member is relatively thick.

While the present invention has been described in terms of the preferred is embodiment above, numerous modifications and/or additions to the above-described preferred embodiments would be readily apparent to one skilled in the art. By way of example, but not limitation, the striking assembly may be incorporated into a non-perimeter weighted iron. It is intended that the scope of the present invention extends to all such modifications and/or additions and that the scope of the present invention is limited solely by the claims set forth below.

I claim:

1. A golf club head, comprising:

a main body portion having a groove formed therein, the groove including a forward facing surface; and a striking assembly associated with the groove, the striking assembly including a front member formed from a relatively hard metal and a rear member formed from a relatively soft metal, the front member defining a ball striking surface and the rear member including a rearward facing surface in substantial contact with the forward facing surface of the groove.

2. A golf club head as claimed in claim 1, wherein the front member includes a plurality of score lines.

3. A golf club head as claimed in claim 2, wherein at least one the score lines extends completely through the front member.

4. A golf club head as claimed in claim 1, wherein the striking assembly defines a maximum length in a lateral direction and includes a plurality of laterally extending score lines, at least some of the score lines defining a length which is substantially equal to the maximum length of the striking assembly.

5. A golf club head as claimed in claim 1, wherein the striking assembly defines a maximum length in a lateral direction and includes a plurality of laterally extending score lines, at least some of the score lines defining a length which is less than the maximum length of the striking assembly.

6. A golf club head as claimed in claim 1, wherein the main body portion defines a cavity and includes a wall portion extending completely across the cavity.

7. A golf club head as claimed in claim 1, wherein the main body comprises an iron-type main body portion.

8. A golf club head as claimed in claim 1, wherein the main body comprises a perimeter weighted iron-type main body portion.

9. A golf club head as claimed in claim 1, wherein the main body comprises a wood-type main body portion.

10. A golf club head, comprising:

a main body portion having a groove formed therein; and a striking assembly associated with the groove, the striking assembly including a front member formed from a relatively hard material and a rear member secured to the front member and formed from a relatively soft material, and the front member defining a ball striking surface;

wherein one of the front member and the rear member includes a plurality of ridges and the other of the front member and the rear member includes a plurality of corresponding indentations.

11. A golf club head as claimed in claim 10, wherein the ridges are received in the indentations.

12. A golf club head, comprising:

a main body portion having a groove formed therein; and a striking assembly associated with the groove, the striking assembly including a front member formed from a relatively hard material and a rear member formed from a relatively soft material, and the front member defining a ball striking surface;

wherein the front member extends at least one of vertically above and vertically below the rear member.

13. A golf club head as claimed in claim 12, wherein the front portion includes at least one rearwardly extending protrusion and the rear portion includes at least one rearwardly extending protrusion.

14. A method of forming a golf club head, comprising the steps of:

forming a main body portion having a forward facing surface;

forming a striking assembly separate from the main body portion, the striking assembly including a front portion formed from a relatively hard metal and a rear portion formed from a relatively soft metal; and securing the striking assembly to the main body portion in such a manner that the front portion defines a ball striking surface and the rear portion is in contact with the forward facing surface of the main body.

15. A method as claimed in claim 14, wherein the step of forming a main body portion comprises forming a main body portion defining a groove and the step of securing the striking assembly to the main body portion comprises securing the striking assembly within the groove.

16. A method as claimed in claim 14, further comprising the step of:

forming score lines in the front portion.

* * * * *